US007255428B2

(12) United States Patent
Hara

(10) Patent No.: US 7,255,428 B2
(45) Date of Patent: Aug. 14, 2007

(54) DROPLET EJECTION HEAD AND DROPLET EJECTION APPARATUS

(75) Inventor: Kazumi Hara, Suwa (JP)

(73) Assignee: Seiko Epson Corporation (JP)

( * ) Notice: Subject to any disclaimer, the term of this patent is extended or adjusted under 35 U.S.C. 154(b) by 13 days.

(21) Appl. No.: 11/229,163

(22) Filed: Sep. 16, 2005

(65) Prior Publication Data

US 2006/0082616 A1 Apr. 20, 2006

(30) Foreign Application Priority Data

Oct. 20, 2004 (JP) ..... 2004-305521

(51) Int. Cl.
*B41J 2/045* (2006.01)

(52) U.S. Cl. ..... 347/70

(58) Field of Classification Search ..... None
See application file for complete search history.

(56) References Cited

U.S. PATENT DOCUMENTS 6,851,778 B2 * 2/2005 Okuda ..... 347/10
7,105,931 B2 * 9/2006 Attarwala ..... 257/783
2003/0020787 A1 * 1/2003 Nakamura et al. ..... 347/57
2005/0001968 A1 * 1/2005 Yamazaki et al. ..... 349/152
2005/0097716 A1 * 5/2005 Takakuwa et al. ..... 29/25.35
2005/0180679 A1 * 8/2005 Simizu et al. ..... 385/14

FOREIGN PATENT DOCUMENTS

JP 2000254584 A * 9/2000
JP 2003-182076 7/2003
JP 2004-034293 2/2004
JP 2004-148813 5/2004

* cited by examiner

*Primary Examiner*—Lamson Nguyen
*Assistant Examiner*—Justin Seo
(74) *Attorney, Agent, or Firm*—Harness, Dickey & Pierce, P.L.C.

(57) ABSTRACT

There is provided a droplet ejection head that is small in size, provides high productivity, and is extremely reliable. The droplet ejection head of the present invention includes pressure generating chambers that are connected to nozzle apertures, an elastic membrane (i.e., a diaphragm) that constitutes a portion of the pressure generating chambers, piezoelectric elements that are placed on a surface of the elastic membrane on the opposite side from the pressure generating chambers, and cause pressure changes to be generated inside the pressure generating chambers, and drive IC (i.e., drive elements) that drive the piezoelectric elements. In this droplet ejection head, the drive IC are flip-chip bonded to terminals that are provided on the piezoelectric elements.

6 Claims, 5 Drawing Sheets

DROPLET EJECTION HEAD AND DROPLET EJECTION APPARATUS

BACKGROUND OF THE INVENTION

1. Field of the Invention

The present invention relates to a droplet ejection head and a droplet ejection apparatus.

Priority is claimed on Japanese Patent Application No. 2004-305521, filed Oct. 20, 2004, the content of which is incorporated herein by reference.

2. Description of Related Art

Inkjet printers are known as printers that can provide high speed printing with a high image quality. Inkjet printers are equipped with an inkjet recording head that is provided with a cavity (i.e., a pressure generating chamber) having a changeable internal volume. Inkjet printers perform a printing operation by ejecting ink droplets from nozzles in the head while the head is being scanned. Conventionally, ceramic piezoelectric elements represented by PZT (Pb $(Zr_xTi_{1-x})O_3$) are used as head actuators in this type of inkjet recording head. These piezoelectric elements are driven by a drive IC that is mounted on the head. This drive IC may be fixed, for example, onto a bonding substrate that is bonded to one surface side of a flow path forming substrate where the cavity is formed, and is electrically connected by wire bonding or the like to the respective piezoelectric elements (see Unexamined Patent Application, First Publication Nos. 2004-148813, 2003-182076, and 2004-34293).

However, even faster speeds and higher image quality are being demanded in inkjet printers. One technique that cannot be overlooked in order to respond to these demands is to increase the density of the nozzles in the inkjet recording head. Because of this, it is accordingly necessary to achieve higher density packaging and size reductions for the drive IC that drives the piezoelectric elements. However, because wire bonding is employed in current inkjet recording heads, problems occur if such size reductions and higher density packaging are pursued such as short-circuiting occurring due to contact between wires, and a fall in the production efficiency being generated. Namely, by miniaturizing the terminals, a reduction in the size of the drive IC, an increase in the yield from a wafer, and a lowering of costs become possible, however, because of the aforementioned problems, there is a limit of approximately 60 μm to the pitch of the wire bonding, and this will not be able to be overcome in future.

Note that such problems apply not only to inkjet recording heads that eject printing ink, but also apply to droplet ejection heads that eject a liquid other than ink. For example, these problems also occur in droplet ejection heads that are used when a functional film (i.e., metal wiring or the like) is formed by ejecting a liquid that contains a functional material such as fine metal particles onto a substrate, and then drying and baking the substrate.

SUMMARY OF THE INVENTION

The present invention was conceived in view of the above described circumstances and it is an object thereof to provide a droplet ejection head that is small in size, has high productivity, and also excellent reliability. It is a further object of the present invention to provide a droplet ejection apparatus that makes high density printing possible by using this droplet ejection head.

In order to solve the above described problems, the droplet ejection head of the present invention includes:

pressure generating chambers that are connected to nozzle apertures; a diaphragm that constitutes a portion of the pressure generating chambers; piezoelectric elements that are placed on a surface of the diaphragm on the opposite side from the pressure generating chambers, and cause pressure changes to be generated inside the pressure generating chambers; and drive elements that drive the piezoelectric elements, wherein the drive elements are flip-chip bonded to terminals that are provided on the piezoelectric elements.

By employing this structure, there is higher production efficiency compared to a conventional structure in which bonding is achieved using wire bonding. Moreover, by employing flip-chip bonding, it is possible to prevent short-circuiting caused by contact between wires that occurred, conventionally, when wire bonding was employed. Because of this, by miniaturizing the terminals, the size of the drive elements can be reduced, the yield from a wafer can be increased, and cost reductions are made possible. Moreover, because the drive elements are placed on the same substrate as the piezoelectric elements, the thickness of the head overall can be reduced which also contributes to a reduction in size.

In the droplet ejection head of the present invention, a structure can be employed in which the pressure generating chambers are formed on a flow path forming substrate, the diaphragm is formed on a surface of the flow path forming substrate on the opposite side from the pressure generating chambers, the piezoelectric elements and the drive elements are placed on a surface of the diaphragm on the opposite side from the flow path forming substrate, a protective substrate is provided on the surface of the flow path forming substrate on which the piezoelectric elements and the drive elements are placed, an aperture portion for leading out wires is provided in the protective substrate at a position thereof that corresponds to the drive elements, and the drive elements are bonded by wire bonding via the aperture portion to terminals that are formed on a surface of the protective substrate on the opposite side from the drive elements. Here, it is possible to employ a structure in which the protective substrate has piezoelectric element holding portions that, in a state in which a space has been secured in an area facing the piezoelectric elements and the drive elements, tightly seal this space.

By providing the protective substrate in this manner, it is possible to prevent damage to the piezoelectric elements and the like that is due to the external environment.

In the droplet ejection head of the present invention, it is desirable that a structure be employed in which the protective substrate and the drive elements are adhered together, and the protective substrate is supported by the drive elements.

By using packaged drive elements as structural bodies for supporting the protective substrate, it is not necessary to provide a separate supporting member and reductions in both the size and cost of the head can be achieved.

The droplet ejection apparatus of the present invention is provided with the above described droplet ejection apparatus of the present invention. Here, the term "droplet ejection apparatus" refers not only to printers that are constructed as stand alone units, but also includes printer units that print while being attached to other devices. Specifically, printer units exist that are attached to display devices such as televisions and print images that are displayed on such display devices. Moreover, the above described droplet ejection head can be applied not only to printing apparatuses that print script and images, but also, for example, to wire forming apparatuses that place a liquid material that contains wiring material on a substrate such as glass, and then dry it so as to form wires, and also to film forming apparatuses that are used to form other functional films.

By employing this type of structure, because a low-cost droplet ejection head is used, it is possible to provide a droplet ejection apparatus that is small in size and extremely reliable and costs even less.

DETAILED DESCRIPTION OF THE INVENTION (Droplet Ejection Head)

Figure 1:
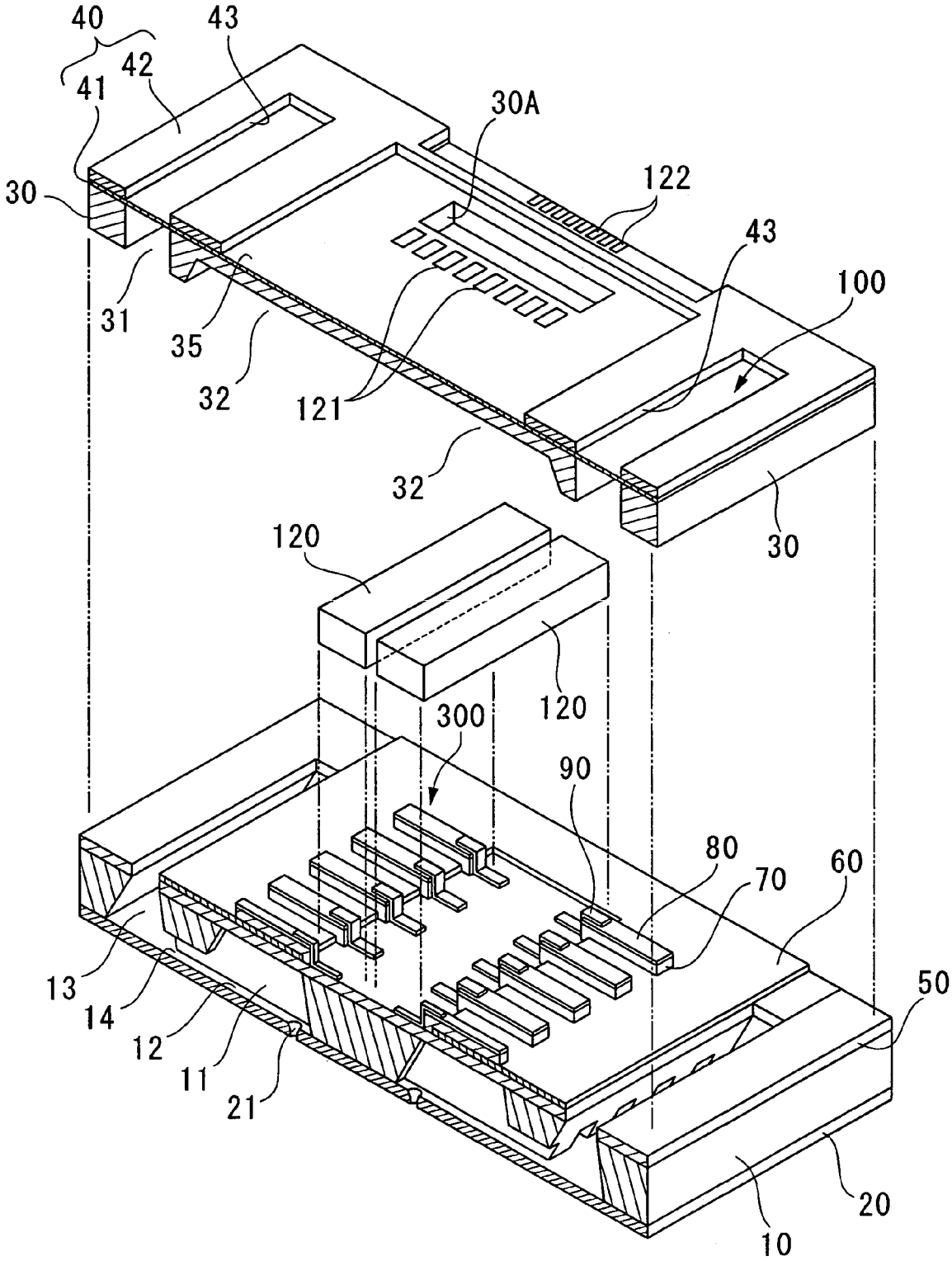
FIG. 1 is an exploded perspective view of an inkjet of recording head.
Figure 2A:
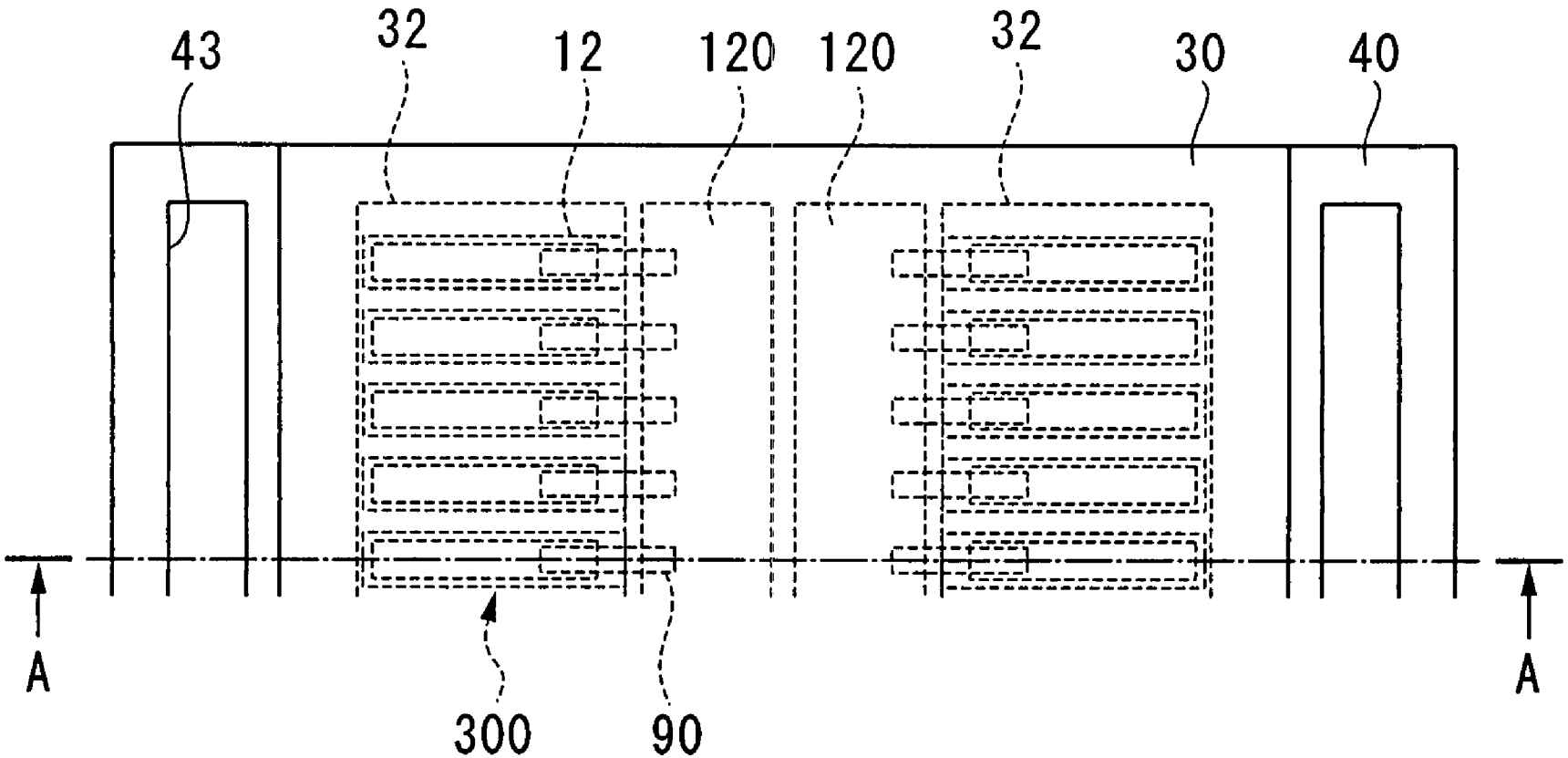
FIG. 2A is a plan view showing of an inkjet of recording head.
Figure 2B:
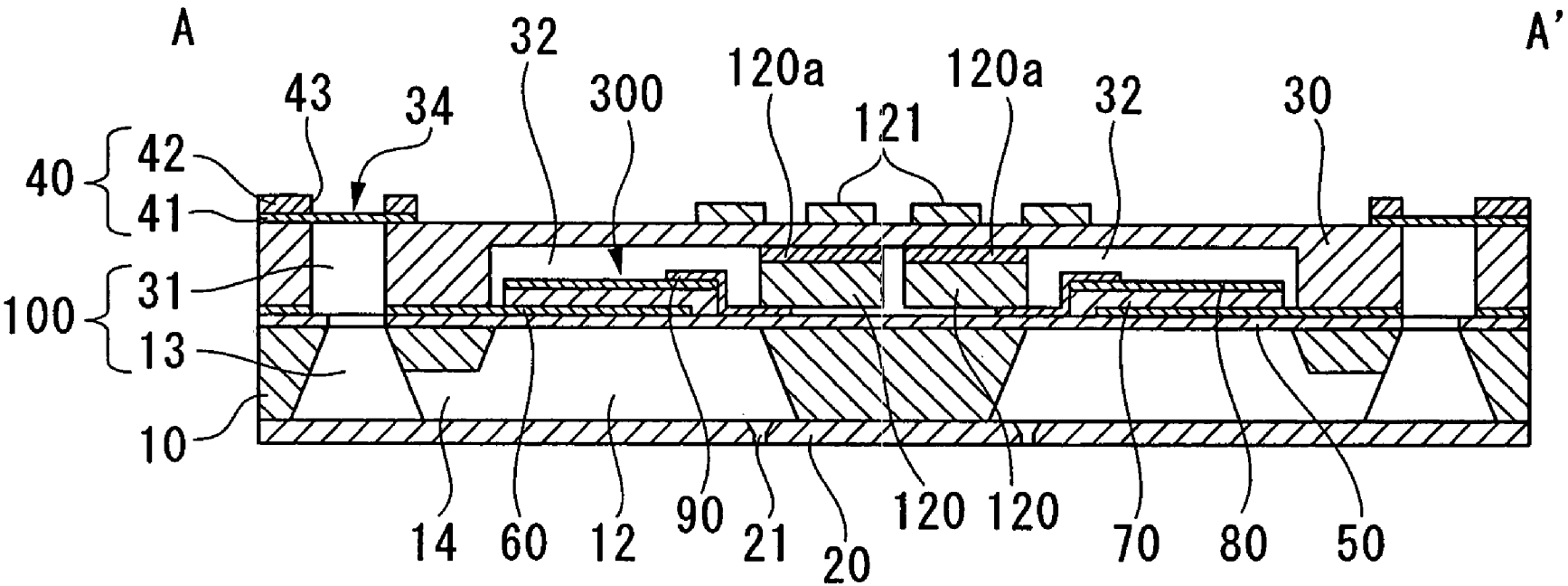
FIG. 2B is a cross-sectional view showing of the same.

FIG. 1 is an exploded perspective view showing an inkjet recording head which is an example of the droplet ejection head of the present invention. FIG. 2A is a plan view showing of FIG. 1, FIG. 2B is a cross-sectional view showing of the same.

As shown in the drawings, a flow path forming substrate 10 is formed in the present embodiment by an orientation (110) silicon monocrystalline substrate. One surface of this flow path forming substrate 10 is an aperture surface, while on the other surface is formed an elastic membrane (i.e., a diaphragm) 50 having a thickness of 1 to 2 μm that is formed in advance by thermal oxidation from silicon dioxide. A plurality of partition walls 11 are formed by the anisotropic etching of a silicon monocrystalline substrate on the aperture surface (i.e., the surface on the opposite side from the elastic membrane 50) of the flow path forming substrate 10. Two rows of pressure generating chambers 12 that are parallel in the transverse direction and that are partitioned by the plurality of partition walls 11 are provided on this aperture surface. A connecting portion 13 that is connected to a reservoir section 31 of a protective substrate 30 (described below) and constitutes a portion of a reservoir 100, which is a common ink chamber for each pressure generating chamber 12, is formed on an outer side in the longitudinal direction of the pressure generating chambers 12. The connecting portion 13 is connected via respective ink supply paths 14 to one end portion in the longitudinal direction of each pressure generating chamber 12.

Here, the anisotropic etching is performed using the difference in etching rates of silicon monocrystalline substrates. For example, in the present embodiment, the following property of silicon monocrystalline substrates is made use of. Namely, if a silicon monocrystalline substrate is immersed in an alkaline solution of KOH or the like, it is gradually eroded, and a first (111) surface that is orthogonal to the (110) surface and a second (111) surface that forms an angle of approximately 70° relative to the first (111) surface and that forms an angle of approximately 35° relative to the (110) surface both appear. In addition, the etching rate of the (111) surface is approximately $1/180^{th}$ of the etching rate of the (110) surface. Using this anisotropic etching, precision machining can be performed based on machining to the depth of the rectangular parallelogram that is formed by two first (111) surfaces and two oblique second (111) surfaces, and the pressure generating chambers 12 can be laid out in a high density pattern.

In the present embodiment, the long sides of each pressure generating chamber 12 are formed by the first (111) surfaces while the short sides thereof are formed by the second (111) surfaces. The pressure generating chambers 12 are formed by performing etching so as to substantially penetrate the flow path forming substrate 10 and reach the elastic membrane 50. Here, the amount of the elastic membrane 50 that is immersed in the alkaline solution that etches the silicon monocrystalline substrate is extremely small. Moreover, each of the ink supply paths 14 that are connected to one end of the respective pressure generating chambers 12 is formed shallower than the pressure generating chambers 12, and maintains a constant flow path resistance to the flow of ink that flows into the pressure generating chambers 12. Namely, the ink supply paths 14 are formed by etching (i.e., half etching) the silicon monocrystalline substrate to a partway point in the thickness direction. Note that half etching is performed by adjusting the etching time.

The thickness of the flow path forming substrate 10 may be set to the optimum thickness to match the layout density of the pressure generating chambers 12. For example, for a layout density of approximately 180 dpi, the thickness of the flow path forming substrate 10 may be approximately 220 μm. However, if the pressure generating chambers 12 are laid out in a comparatively high density of 200 dpi or more, then it is preferable that the thickness of the flow path forming substrate 10 be a comparatively thin 100 μm or less. This is because this thickness makes a higher layout density possible while allowing the rigidity of the partition wall 11 between adjacent pressure generating chambers 12 to be maintained.

A nozzle plate 20, in which nozzle apertures 21 are formed that are connected to the opposite side of each pressure generating chamber 12 to the ink supply path 14 side, is fixed via an adhesive agent or a heat welding film or the like to the aperture surface side of the flow path forming substrate 10. Note that the nozzle plate 20 is formed from a glass ceramic or from stainless steel or the like having a thickness of, for example, 0.1 to 1 mm, and having a coefficient of linear expansion at 300° C. or less of, for example, 2.5 to 4.5 ($\times 10^{-6}$/° C.). One surface of the nozzle plate 20 covers one entire surface of the flow path forming substrate 10, and the nozzle plate 20 also has the function of a reinforcing plate in that it protects the silicon monocrystalline substrate from shock and external force. Moreover, the nozzle plate 20 may also be formed from a material whose coefficient of thermal expansion is substantially the same as that of the flow path forming substrate 10. In this case, because any deformation that is caused by heat is substantially the same in the flow path forming substrate 10 and the nozzle plate 20, they are easily bonded together using a thermosetting adhesive agent or the like.

Here, the size of the pressure generating chambers 12 that impart ink droplet ejection pressure to the ink and the size of the nozzle apertures 21 that eject the ink droplets are optimized in accordance with the quantity of ink droplets being ejected, the ejection speed, and the ejection frequency. For example, if 360 ink droplets per square inch are being recorded, then it is necessary for the nozzle apertures 21 to be formed accurately with a diameter of several tens of μm.

In contrast, piezoelectric elements 300 are formed on the elastic membrane 50 that is on the opposite side of the flow path forming substrate 10 to the aperture surface side. These piezoelectric elements 300 are formed using the process described below by providing a base electrode film 60 having a thickness, for example, of approximately 0.2 μm, and then stacking a piezoelectric material layer 70 having a thickness of, for example, approximately 1 μm and a top electrode film 80 having a thickness of, for example, approximately 0.1 μm thereon. Here, the term "piezoelectric elements" refers to a portion that includes the base electrode film 60, the piezoelectric material layer 70, and the top electrode film 80. Generally, one of the electrodes of the piezoelectric elements 300 is used as a common electrode, while the other electrode and the piezoelectric material layer 70 are patterned for each respective pressure generating chamber 12.

In addition, here, a portion that is formed by the patterned electrode and the piezoelectric material layer 70 and in which a piezoelectric distortion is generated by the application of a voltage to the two electrodes is referred to as a "piezoelectric material active portion". In the present embodiment, the base electrode films 60 are used as the common electrode for the piezoelectric elements 300, while the top electrode films 80 are used as the individual electrodes of the piezoelectric elements 300, however, there is no obstacle to this being reversed due to the requirements of drive circuits and wiring. In either case, a piezoelectric material active portion is formed for each respective pressure generating chamber 12. Moreover, the term "piezoelectric actuator" refers here to a combination of a piezoelectric element 300 and a diaphragm in which a displacement is generated as a result of the relevant piezoelectric element 300 being driven.

Lead electrodes 90 that are formed, for example, from gold (Au) or the like are connected respectively to each of these piezoelectric elements 300. These lead electrodes 90 are provided extending from the vicinity of an end portion in the longitudinal direction of each piezoelectric element 300 onto an area of the elastic membrane 50 that corresponds to an area between rows of the pressure generating chambers 12. Terminals that are used for packaging are provided on the lead electrodes 90, and drive IC (i.e., semiconductor integrated circuits) 120, which are drive elements for driving the piezoelectric elements 300, are flip-chip bonded onto the terminals. Terminals of the drive IC 120 are formed by forming an Au plated film having a film thickness of 1 μm on a surface of, for example, a TiW layer. Because a method in which heat and pressure are applied is used to connect the drive IC 120, it is desirable that a sufficient substrate thickness be secured underneath the portion where the drive IC 120 are packaged. In the present embodiment, the drive IC 120 are packaged at a position that corresponds to an area between the rows of the pressure generating chambers 12 which position is also a portion where the flow path forming substrate 10 has not been etched. In addition to using a soldering method for the bonding, a method in which Au bumps (i.e., stud bumps) are formed on the drive IC 120 side and bonding is achieved using Ag paste can be used, a method that uses an anisotropic conductive film or an anisotropic conductive adhesive agent can be used, and a method that uses an adhesive sheet or an adhesive agent can be used. When an alloy bond is made, in order to ensure reliability, sealing and reinforcing can be performed using a sealing material such as a thermosetting resin. However, it is desirable that the sealing material do not encroach on the area of the piezoelectric elements 300. Moreover, it is also possible to form bumps on portions corresponding to pads of the flow path forming substrate 10 and connect them using an anisotropic conductive film, an adhesive agent, or the like.

The protective substrate 30 that has the reservoir section 31 that constitutes at least a portion of the reservoir 100 is bonded onto the flow path forming substrate 10 on which these piezoelectric elements 300 are formed. The reservoir section 31 is formed penetrating the protective substrate 30 in the thickness direction thereof, and extending across the transverse direction of the pressure generating chambers 12. As is described above, the reservoir section 31 is connected to the connecting portion 13 of the flow path forming substrate 10 and forms the reservoir 100 which is the common ink chamber for each of the pressure generating chambers 12. Moreover, a piezoelectric element holding portion 32 that is capable of tightly sealing a space that has been secured so as to ensure that the operations of the piezoelectric elements 300 are not obstructed is provided for each pressure generating chamber 12 in an area opposite the drive IC 120 and the piezoelectric elements 300 of the protective substrate 30. As a result, the piezoelectric elements 300 and the drive IC 120 are tightly sealed inside the respective piezoelectric element holding portions 32. It is preferable that a material such as, for example, a glass or ceramic material that has the same thermal coefficient of expansion as that of the flow path forming substrate 10 be used for this protective substrate 30. In the present embodiment, the protective substrate 30 is formed using a silicon monocrystalline substrate, which is the same material as that of the flow path forming substrate 10.

Moreover, as shown in FIGS. 2A and 2B, in the present embodiment, the drive IC 120 are adhered onto an inner surface of the piezoelectric element holding portions 32 by an adhesive agent 120*a* that is placed on the top surfaces of the drive IC 120 (i.e., the surfaces thereof on the opposite side from the flow path forming substrate 10 side). The protective substrate 30 is placed in a state such that the inner surfaces of the piezoelectric element holding portions 32 are supported by the drive IC 120. The adhesion between the protective substrate 30 and the drive IC 120 can be achieved at the same time that the protective substrate 30 is adhered to the flow path forming substrate 10. Namely, after the drive IC 120 have been packaged, an adhesive agent or an adhesive sheet is supplied to the top surfaces of the drive IC 120, and the top surfaces of the drive IC 120 are adhered to the inner surfaces of the piezoelectric element holding portions 32 when the protective substrate 30 is being adhered to the flow path forming substrate 10. At this time, by using an adhesive agent that has excellent thermal conduction as the adhesive agent 120*a*, heat that is generated in the drive IC 120 is allowed to escape to the protective substrate 30 side. It is desirable that the thickness of the drive IC 120 be optimally set after consideration is given to the thickness of the adhesive agent 120*a* and the like. For example, it is desirable that the thickness be adjusted by grinding the drive IC 120 beforehand so that the thickness thereof equals the height of the piezoelectric element holding portions 32 (i.e., the depth to which the protective substrate 30 is cut out) minus the thickness of the adhesive agent 120*a* after the connection is made and minus the gap that is formed by the connection.

Figure 3:
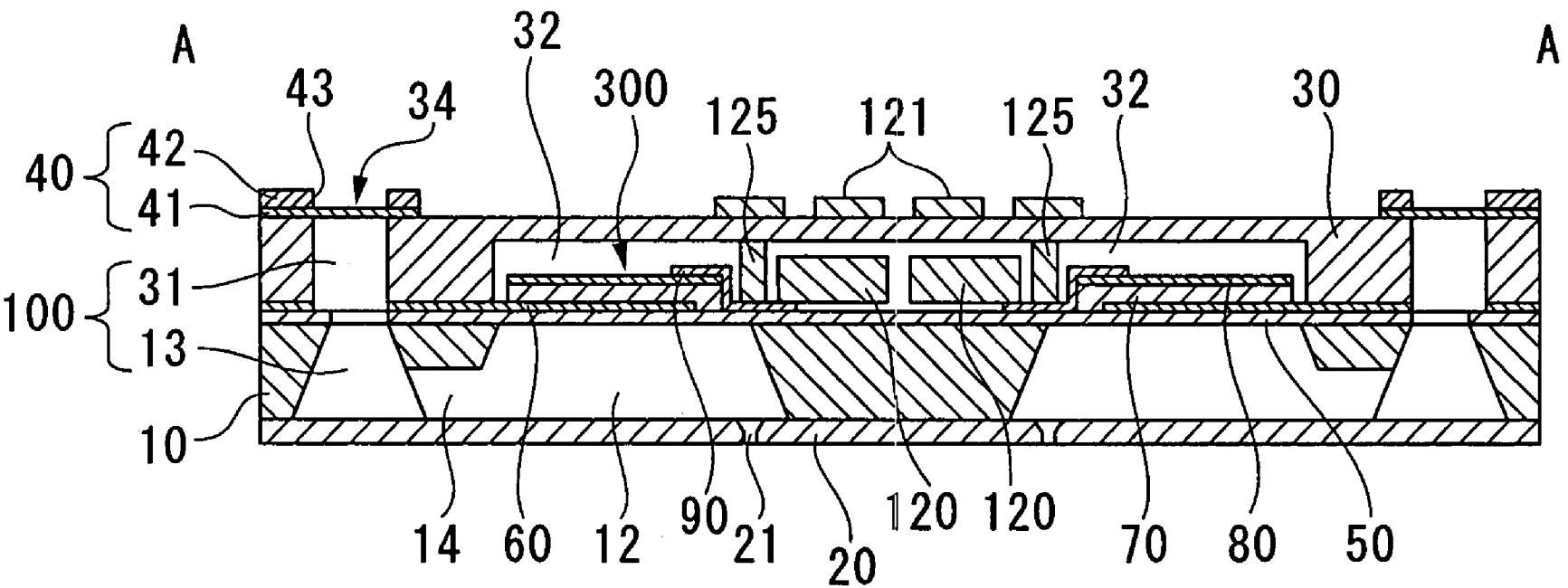
FIG. 3 is a cross-sectional view showing another structural example of an inkjet of recording head.

Note that, in FIGS. 2A and 2B, the drive IC 120 form a portion of a supporting body for the protective substrate 30, however, the structure of the present invention is not limited to this structure. For example, as is shown in FIG. 3, the protective substrate 30 may also be supported by supporting members 125 that are separate from the drive IC 120. It is preferable that these supporting members 125 be formed from the same material that is used to form the protective substrate 30. In this case, because the supporting members 125 can be formed at the same time as the piezoelectric element holding portions 32 are formed by etching the protective substrate 30, the manufacturing process does not become more complicated. However, if the supporting members 125 are provided separately in this manner, surplus space is required inside the piezoelectric element holding portions 32 in order to house the supporting members 125. Therefore, from the standpoint of reducing the size of the head, this structure is slightly less advantageous than the structure shown in FIGS. 2A and 2B.

An insulating film (not shown) that is formed, for example, from silicon dioxide or the like is provided on a surface of the protective substrate 30, namely, on the surface on the opposite side from the surface that is bonded to the flow path forming substrate 10. A plurality of terminals 121 for connecting to the drive IC 120 are provided on this insulating film. A through hole 30A that penetrates the protective substrate 30 in the thickness direction is provided as an aperture portion for extracting wires at a position on the protective substrate 30 that corresponds to the respective drive IC 120. Moreover, pads (not shown) that are connected to the drive IC 120 are provided at positions facing the through hole 30A of the flow path forming substrate 10. These pads and the terminals 121 that are placed on the protective substrate are electrically connected by connecting wires (not shown) that are formed by conductive wires such as bonding wires that pass through the interior of the through hole 30A. Lead wires (not shown) that are connected to the terminals 121 are provided on the surface of the protective substrate 30. The terminals 121 are electrically connected by these lead wires to terminals 122 that are used for FPC connections and are formed on an end portion of the protective substrate 30.

A compliance substrate 40 that is formed by a sealing film 41 and a fixing plate 42 is bonded on an area of the protective substrate 30 that corresponds to the reservoir sections 31. Here, the sealing film 41 is formed from a material having a low rigidity as well as flexibility (for example, a polyphenylene sulfide (PPS) film having a thickness of 6 μm). One surface of the reservoir sections 31 is sealed by this sealing film 41. The fixing plate 42 is formed from a hard material such as a metal (for example, stainless steel (SUS) or the like having a thickness of 30 μm). Because the area of this fixing plate 42 that faces the reservoir 100 is formed into the aperture portion 43 that has been completely removed in the thickness direction, one surface of the reservoir 100 is sealed only by the flexible sealing film 41.

The inkjet recording head of the present embodiment that has the above described structure acquires ink from an ink supply apparatus (not shown). Once the interior of this inkjet recording head is filled from the reservoir 100 to the nozzle apertures 21 with ink, drive voltage is applied between the respective base electrode films 60 and top electrode films 80 that correspond to the pressure generating chambers 12 in accordance with drive signals supplied from the drive IC 120 so as to displace the elastic membrane 50, the base electrode film 60, and the piezoelectric material layer 70. As a result, the pressure inside each pressure generating chamber 12 is raised, and ink droplets are ejected from the nozzle apertures 21.

As is described above, in the inkjet recording head of the present embodiment, because the drive IC 120 that are used to drive the piezoelectric elements 300 are flip-chip bonded to terminals that are provided in the piezoelectric elements 300, the production efficiency is higher than in a conventional structure in which they are bonded using bonding wire. Moreover, by employing flip-chip bonding it is possible to prevent short-circuiting that is caused by contact between wires which occurs when conventional wire bonding is employed. Because of this, by miniaturizing the terminals, the size of the drive IC 120 can be reduced, the yield from a wafer can be increased, and cost reductions are made possible. Moreover, because the drive IC 120 are placed on the same substrate as the piezoelectric elements 300, the thickness of the head overall can be reduced which also contributes to a reduction in size. Furthermore, in the present embodiment, because the protective substrate 30 is adhered via an adhesive agent to the top surface of the flip-chip bonded drive IC 120 so that the drive IC 120 are used as supporting bodies, it is not necessary to provide separate supporting members in order to support the protective substrate 30. Accordingly, it is possible to achieve a reduction in both the head size and cost.

A preferred embodiment of the present invention is described above with reference made to the drawings, however, it is to be understood that the present invention is not limited to these examples. The various configurations, combinations and the like of the respective structural members in the above description are simply examples, and various modifications can be made based on the design requirements and the like insofar as they do not depart from the scope of the present invention. For example, in the above described embodiment, an example is given of a thin-film type of inkjet recording head that is manufactured using film formation and photolithographic processes, however, it is to be understood that the present invention is not limited to this. For example, the present invention can also be employed in thick-film type inkjet recording heads that are formed using a method in which green sheets are adhered.

Moreover, in the above described embodiment, an inkjet recording head is described as an example of the droplet ejection head of the present invention, however, the basic structure of the droplet ejection head is not limited to the one that is described. The present invention is intended for use with a wide range of general droplet ejection heads, and can naturally be applied to devices that eject a liquid other than ink. Examples of these other droplet ejection heads include various types of recording heads that are used in image recording apparatuses such as printers, coloring material ejection heads that are used in the manufacture of color filters of liquid crystal displays and the like, electrode material ejection heads that are used to form electrodes for organic EL displays, FED (field emission displays), and the like, and bioorganic matter ejection heads that are used in the manufacture of biochips.

(Droplet Ejection Apparatus)

Next, the droplet ejection apparatus of the present invention will be described. Here, an inkjet recording apparatus that is provided with the above described inkjet recording head will be described as an example thereof.

Figure 4:
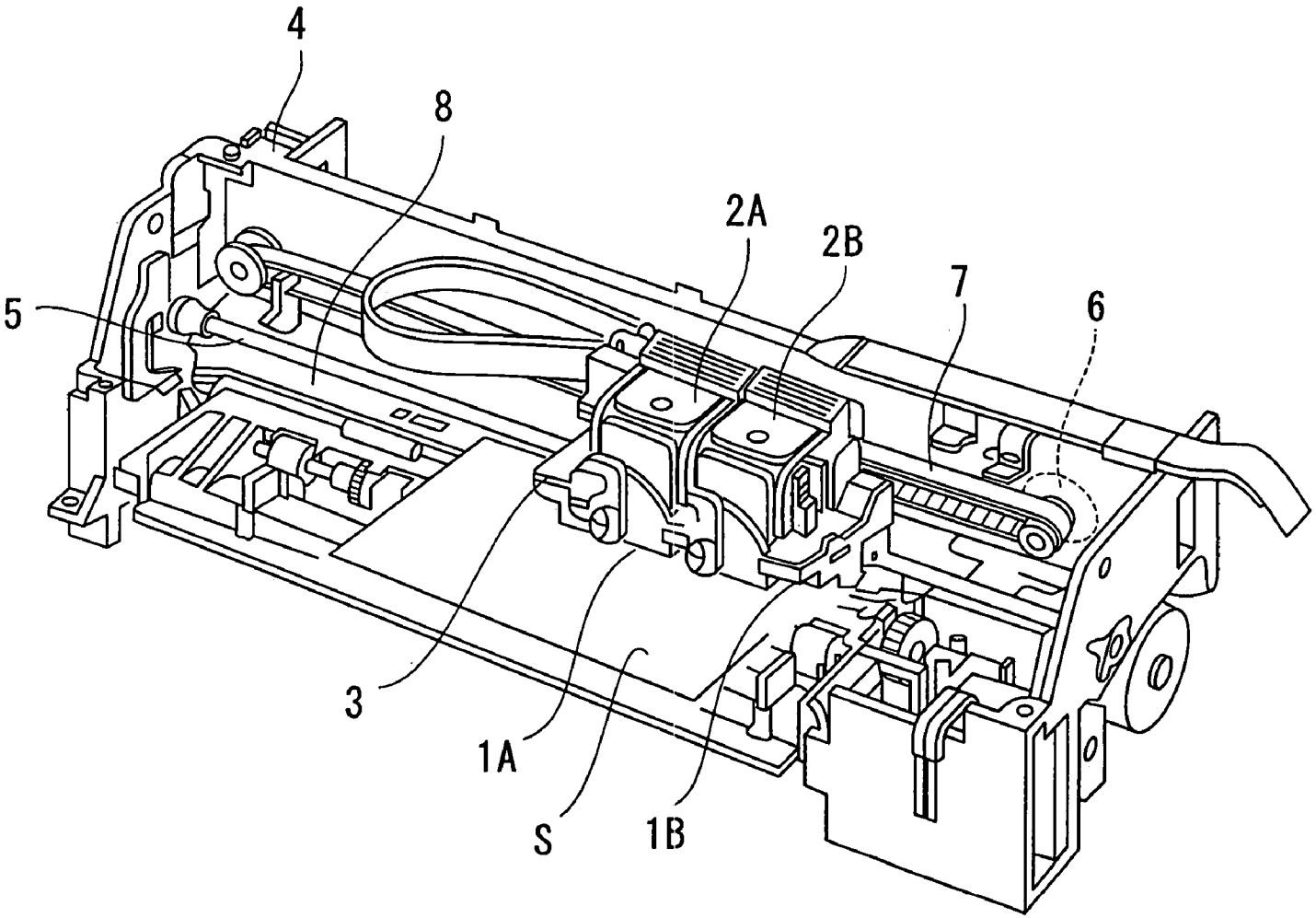
FIG. 4 is a schematic view of an inkjet of recording apparatus.

The above described inkjet recording head constitutes a portion of a recording head unit that is equipped with an ink flow path, which is connected to an ink cartridge or the like, and that is mounted in the inkjet recording apparatus. FIG. 4 is a schematic view showing an example of this inkjet recording apparatus. As is shown in FIG. 4, recording head units 1A and 1B that have inkjet recording heads are equipped with removable cartridges 2A and 2B that constitute ink supply devices. A carriage 3 on which the recording head units 1A and 1B are mounted is provided so as to be able to move freely in an axial direction along a carriage shaft 5 that is mounted on an apparatus body 4. The recording head units 1A and 1B respectively eject, for example, a black ink composition of matter and a color ink composition of matter. As a result of the driving force of a drive motor 6 being transmitted via a plurality of gears (not shown) and a timing belt 7 to the carriage 3, the carriage 3 on which the recording head units 1A and 1B are mounted is moved along the carriage shaft 5. A platen 8 is also provided in the apparatus body 4 extending alongside the carriage shaft 5. A recording sheet S is transported over the platen 8. This recording sheet S is a recording medium such as paper that is fed by paper feed rollers (not shown).

Because this inkjet recording apparatus is provided with the above described inkjet recording head, it is small in size while being extremely reliable, and is also low in cost.

Note that, in FIG. 4, an inkjet recording apparatus is shown as a single printer unit serving as an example of the droplet ejection apparatus of the present invention, however, the present invention is not limited to this. For example, the present invention can be applied to printer units that are obtained by incorporating therein this inkjet recording head. Such printer units are installed in display devices such as televisions and input devices such as whiteboards and are used to print images that are displayed or input by these display devices or input devices.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

What is claimed is:

1. A droplet ejection head comprising:

a first substrate in which a chamber is provided, the chamber being in fluid communication with a nozzle aperture and into which an ink flows;

a diaphragm formed on the first substrate, and constituting a portion of the chamber;

a piezoelectric element placed on a surface of the diaphragm on an opposite side from the chamber, and causing pressure change to be generated inside the chamber;

a drive element that drives the piezoelectric element, and is flip-chip bonded to a terminal of the piezoelectric element;

a second substrate in which an ink channel is provided, disposed on the first substrate and covering the piezoelectric element and the drive element; and an aperture provided on the second substrate at a position thereof corresponding to the drive element, the drive element being bonded by wire bonding via the aperture to a terminal that is formed on a surface of the second substrate on an opposite side from the drive element.

2. A droplet ejection apparatus that is provided with the droplet ejection head according to claim 1.

3. A droplet ejection head comprising:

a first substrate in which a chamber is provided, the chamber being in fluid communication with a nozzle aperture and into which an ink flows;

a diaphragm formed on the first substrate, and constituting a portion of the chamber;

a piezoelectric element placed on a surface of the diaphragm on an opposite side from the chamber, and causing pressure change to be generated inside the chamber;

a drive element that drives the piezoelectric element, and is flip-chip bonded to a terminal of the piezoelectric element; and a second substrate in which an ink channel is provided, disposed on the first substrate and covering the piezoelectric element and the drive element, the second substrate and the drive element being adhered together, at least a part of the second substrate being supported by the drive element.

4. A droplet ejection apparatus that is provided with the droplet ejection head according to claim 3.

5. A droplet ejection head comprising:

a first substrate in which a chamber is provided, the chamber being in fluid communication with a nozzle aperture and into which an ink flows;

a diaphragm formed on the first substrate, and constituting a portion of the chamber;

a piezoelectric element placed on a surface of the diaphragm on an opposite side from the chamber, and causing pressure change to be generated inside the chamber;

a drive element that drives the piezoelectric element, and is flip-chip bonded to a terminal of the piezoelectric element;

a second substrate in which an ink channel is provided, disposed on the first substrate and covering the piezoelectric element and the drive element; and a support member disposed in a space covered by the second substrate and supporting the second substrate relative to the first substrate, the piezoelectric element and the drive element being disposed in the space.

6. A droplet ejection apparatus that is provided with the droplet ejection head according to claim 5.

* * * * *